US010453464B2

(12) United States Patent
Wang et al.

(10) Patent No.: US 10,453,464 B2
(45) Date of Patent: Oct. 22, 2019

(54) DECOMPOSING AUDIO SIGNALS

(71) Applicant: DOLBY LABORATORIES LICENSING CORPORATION, San Francisco, CA (US)

(72) Inventors: Jun Wang, Beijing (CN); Lie Lu, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 93 days.

(21) Appl. No.: 15/326,378

(22) PCT Filed: Jul. 14, 2015

(86) PCT No.: PCT/US2015/040403

§ 371 (c)(1),
(2) Date: Jan. 13, 2017

(87) PCT Pub. No.: WO2016/011048

PCT Pub. Date: Jan. 21, 2016

(65) Prior Publication Data

US 2017/0206907 A1 Jul. 20, 2017

Related U.S. Application Data

(60) Provisional application No. 62/033,727, filed on Aug. 6, 2014.

(30) Foreign Application Priority Data

Jul. 17, 2014 (CN) ..... 2014 1 0357288

(51) Int. Cl.
*G10L 19/02* (2013.01)
*G10L 19/008* (2013.01)
(Continued)

(52) U.S. Cl.
CPC ..... *G10L 19/0204* (2013.01); *G10L 19/008* (2013.01); *G10L 21/0308* (2013.01); *G10L 25/21* (2013.01); *H04S 3/008* (2013.01)

(58) Field of Classification Search
None
See application file for complete search history.

(56) References Cited

U.S. PATENT DOCUMENTS 8,023,660 B2 9/2011 Faller
8,363,865 B1 1/2013 Bottum
(Continued)

FOREIGN PATENT DOCUMENTS

RS 1332 U 8/2013
WO 2010/019750 2/2010
(Continued)

OTHER PUBLICATIONS

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

(Continued)

*Primary Examiner* — Marcus T Riley

(57) ABSTRACT

Example embodiments disclosed herein relate to signal processing. A method for decomposing a plurality of audio signals from at least two different channels is disclosed. The method obtains a set of components that are weakly correlated wherein the set of components generated based on the plurality of audio signals. The method extract a feature from the set of components and determining determines a set of gains associated with the set of components at least in part based on the extracted feature. Each of the gains indicate a proportion of a diffuse part in the associated component and decompose the plurality of audio signals by applying the set of gains to the set of components. Corresponding system and computer program product are also disclosed.

20 Claims, 4 Drawing Sheets

(51) Int. Cl.

| | |
|---|---|
| ***H04S 3/00*** | (2006.01) |
| ***G10L 21/0308*** | (2013.01) |
| ***G10L 25/21*** | (2013.01) |

(56) References Cited

U.S. PATENT DOCUMENTS

| | | | | |
|---|---|---|---|---|
| 8,964,994 | B2 * | 2/2015 | Jaillet | G10L 19/008 381/22 |
| 9,088,855 | B2 * | 7/2015 | Goodwin | H04S 3/008 |
| 9,241,218 | B2 * | 1/2016 | Walther | H04S 3/008 |
| 9,549,253 | B2 * | 1/2017 | Alexandridis | H04R 3/005 |
| 2008/0208600 | A1 * | 8/2008 | Pang | G10L 19/008 704/500 |
| 2008/0219466 | A1 * | 9/2008 | Pishehvar | G10L 19/0212 381/73.1 |
| 2009/0080666 | A1 * | 3/2009 | Uhle | H04R 5/04 381/17 |
| 2009/0092259 | A1 | 4/2009 | Jot | |
| 2009/0252341 | A1 * | 10/2009 | Goodwin | H04S 3/008 381/56 |
| 2009/0299742 | A1 * | 12/2009 | Toman | G10L 21/0208 704/233 |
| 2011/0200196 | A1 | 8/2011 | Disch | |
| 2011/0222694 | A1 | 9/2011 | Del Galdo | |
| 2012/0082319 | A1 | 4/2012 | Jot | |
| 2013/0064374 | A1 | 3/2013 | Lee | |
| 2013/0182852 | A1 | 7/2013 | Thompson | |
| 2014/0072121 | A1 * | 3/2014 | Harma | H04S 5/005 381/1 |
| 2015/0310870 | A1 * | 10/2015 | Vouin | G11B 27/28 704/500 |
| 2017/0206907 | A1 * | 7/2017 | Wang | G10L 19/008 |

FOREIGN PATENT DOCUMENTS

| | | |
|---|---|---|
| WO | 2011/090834 | 7/2011 |
| WO | 2013/040172 | 3/2013 |
| WO | 2014/043476 | 3/2014 |

OTHER PUBLICATIONS

Stanojevic, Tomislav "Surround Sound for a New Generation of Theaters," Sound and Video Contractor, Dec. 20, 1995, 7 pages.
Stanojevic, Tomislav "Virtual Sound Sources in the Total Surround Sound System," SMPTE Conf. Proc.,1995, pp. 405-421.
Stanojevic, Tomislav et al. "Designing of TSS Halls," 13th International Congress on Acoustics, Yugoslavia, 1989, pp. 326-331.
Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.
Stanojevic, Tomislav et al. "The Total Surround Sound (TSS) Processor," SMPTE Journal, Nov. 1994, pp. 734-740.
Stanojevic, Tomislav et al. "The Total Surround Sound System (TSS System)", 86th AES Convention, Hamburg, Germany, Mar. 7-10, 1989, 21 pages.
Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.
Stanojevic, Tomislav et al. "TSS System and Live Performance Sound" 88th AES Convention, Montreux, Switzerland, Mar. 13-16, 1990, 27 pages.
Thompson, J. et al "Direct-Diffuse Decomposition of Multichannel Signals Using a System of Pairwise Correlations" AES Convention, presented at the 133rd convention, Oct. 25, 2012, Spatial Audio Processing, pp. 1-15.
Gundry, Kenneth "A New Active Matrix Decoder for Surround Sound" AES 19th International Conference: Surround Sound—Techniques, Technology, and Perception, Jun. 1, 2001, pp. 1-9.
Merimaa, J. et al "Correlation-Based Ambience Extraction from Stereo Recordings" AES Convention, Signal Processing for 3-D Audio, Paper 7282, Oct. 1, 2007, pp. 1-15.
Baek, Yong-Hyun et al "Efficient Primary-Ambient Decomposition Algorithm for Audio Upmix" AES Convention Spatial Audio, Oct. 25, 2012, pp. 1-7.
Briand, M. et al "Parametric Coding of Stereo Audio Based on Principal Component Analysis" Proc. of the 9th International Conference on Digital Audio Effects, Montreal, Canada, Sep. 18-20, 2006, pp. DAFX1-DAFX8.
Pulkki, V. et al "Directional Audio Coding—Perception-Based Reproduction of Spatial Sound" International Workshop on the Principles and Applications of Spatial Hearing, Nov. 11-13, 2009, Zao, Miyagi, Japan, pp. 1-4.
Faller, C. et al "Binaural Reproduction of Stereo Signals Using Upmixing and Diffuse Rendering" AES Convention presented at the 131st Convention, Oct. 19, 2011, pp. 1-8.
Goodwin M. et al "Primary-Ambient Signal Decomposition and Vector-Based Localization for Spatial Audio Coding and Enhancement" IEEE International Conference on Acoustics, Speech, and Signal Processing, Apr. 15, 2007, pp. 1-9.
Harma, Aki "Estimation of the Energy Ratio Between Primary and Ambience Components in Stereo Audio Data" 19th European Signal Processing Conference, Barcelona, Spain, Aug. 29-Sep. 2, 2011, pp. 1643-1647.
Dressler, Roger "Dolby Surround Pro Logic Decoder Principles of Operation", Tech. Rep., Dolby Laboratories, 2000, pp. 1-16.
Suykens, J. A K et al "Least Squares Support Vector Machines" World Scientific, Singapore, 2002, (ISBN 981-238-151-1).

* cited by examiner

DECOMPOSING AUDIO SIGNALS

CROSS REFERENCE TO RELATED APPLICATIONS

This application claims priority to Chinese Patent Application No. 201410357288.8, filed on Jul. 17, 2014 and U.S. Provisional Patent Application No. 62/033,727, filed on Aug. 6, 2014, each of which is hereby incorporated by reference in its entirety.

TECHNOLOGY

Example embodiments disclosed herein generally relate to signal processing, and more specifically, to decomposing a plurality of audio signals from at least two different channels into direct and/or diffuse signals.

BACKGROUND

In many applications, such as audio upmixing, audio authoring and the like, an upmixing technique may be employed to create an immersive sound field. In such an application, multichannel audio signals may usually need to be decomposed into direct and/or diffuse signals.

As used herein, the term "direct signal" or "direct component" refers to an audio signal or component that gives an impression to a listener that a heard sound has an apparent direction. The term "diffuse signal" or "diffuse component" refers to an audio signal or component that gives an impression to a listener that the heard sound does not have an apparent direction or is emanating from a lot of directions around the listener. Typically, a direct signal may be a more dominant sound signal among multichannel audio signals, which is originated from a direct sound source and panned among channels. A diffuse signal may be a less dominant sound signal among the multichannel audio signals, which is weakly correlated with the direct sound source and/or distributed across channels, such as an ambiance sound, reverberation, etc. As used herein, the term "dominant signal" or "dominant component" refers to a signal or component having a larger power among a plurality of signals or components.

It is desirable to provide an approach to more precisely decompose the multichannel audio signals so as to provide a more immersive sound field.

SUMMARY

In order to address the foregoing and other potential problems, the example embodiments proposes a method and system for decomposing a plurality of audio signals from at least two different channels.

In one aspect, example embodiments disclosed herein provide a method for decomposing a plurality of audio signals from at least two different channels. The method obtains a set of components that are weakly correlated wherein the set of components are generated based on the plurality of audio signals. The method then extract a feature from the set of components and determines a set of gains associated with the set of components at least in part based on the extracted feature. Each of the gains indicate a proportion of a diffuse part in the associated component and decompose the plurality of audio signals by applying the set of gains to the set of components. Embodiments in this regard further include a corresponding computer program product.

In another aspect, example embodiments disclosed herein provide a system for decomposing a plurality of audio signals from at least two different channels. The system includes a component obtaining unit configured to obtain a set of components that are weakly correlated wherein the set of components are generated based on the plurality of audio signals. The system also includes a feature extracting unit configured to extract a feature from the set of components as well as a gain determining unit configured to determine a set of gains associated with the set of components at least in part based on the extracted feature, each of the gains indicating a proportion of a diffuse part in the associated component. Also include in the system is a decomposing unit configured to decompose the plurality of audio signals by applying the set of gains to the set of components.

Through the following description, it would be appreciated that according to example embodiments disclosed herein, characteristic of directionality and diffusion of a plurality of audio signals from a plurality of channels may be analyzed more precisely based on a set of weakly correlated components generated based on the audio signals. As a result, the decomposition of the audio signals may be more precise such that a more immersive sound field may be created.

Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several embodiments will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
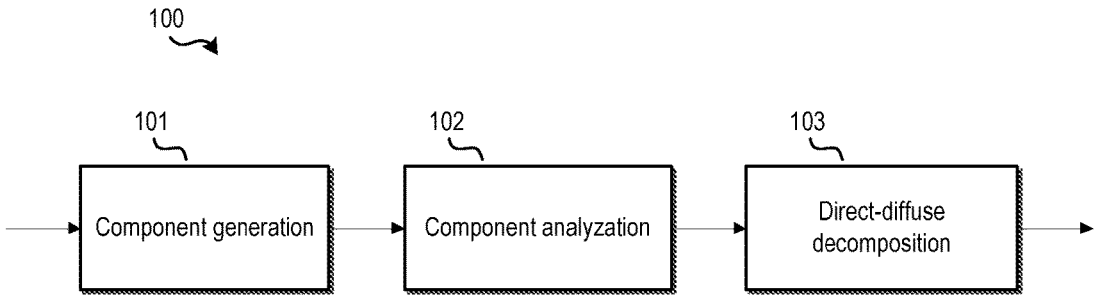
FIG. 1 illustrates a block diagram of a procedure for decomposing a plurality of audio signals from at least two different channels according to some example embodiments.

Principles of the example embodiments will now be described with reference to various example embodiments illustrated in the drawings. It should be appreciated that depiction of these embodiments is only to enable those skilled in the art to better understand and further implement the example embodiments, and is not intended to limit the scope in any manner.

As used herein, the term "includes" and its variants are to be read as open terms that mean "includes, but is not limited to." The term "based on" is to be read as "based at least in part on." The term "one embodiment" and "an embodiment" are to be read as "at least one embodiment." The term "another embodiment" is to be read as "at least one other embodiment." Other definitions, explicit and implicit, may be included below.

In a traditional approach to decompose a multichannel audio signal, the original multichannel audio signal is analyzed directly, and then a component having a largest power is determined as a direct component, and other components are determined as diffuse components. Such an approach may be too rough in an application where an improved artistic effect of output audio signals is desired. In the application, it may be desired to provide the listener with a more immersive diffuse sound field, or with a sensation of more aural components having apparent directions within an enveloping diffuse sound field having no apparent direction.

In order to address the above and other potential problems, some example embodiments propose a method and system for decomposing a plurality of audio signals from at least two different channels. In the method and system, a set of weakly correlated components are generated based on the plurality of audio signals. Then, analysis is performed on the weakly correlated components to perform the direct-diffuse decomposition on the audio signals based on the analysis. Due to the weak correlation between the generated components, the characteristic of directionality and diffusion of the audio signals may be analyzed more precisely. Therefore, the decomposition of the audio signals may be more precise and a more immersive sound field may be created.

Reference is first made to FIG. 1 which illustrates a block diagram of a procedure 100 for decomposing a plurality of audio signals from at least two different channels according to some example embodiments. By way of example, those different channels may be selected from a plurality of channels, such as stereo channels, 5.1 channels, 7.1 channels or the like. Each of the plurality of audio signals is associated with one of those different channels.

As described above, in the traditional multichannel audio signal decomposition, analysis process is directly applied onto the original input multichannel audio signal. It should be appreciated that several correlated direct and diffuse components may be mixed in the original multichannel audio signal. The correlation between the direct and diffuse components is very likely to decrease the preciseness of the analysis. According to e example embodiments disclosed herein, instead of directly applying analysis, a set of components that are weakly correlated are generated based on the plurality of audio signals from at least two different channels. Then, the analysis and further the decomposition are performed based on the generated components. As such, the diffuse sound field and/or steered sound image resulted from decomposition may have higher quality.

As shown in FIG. 1, at block 101, a set of weakly correlated components are generated based on the plurality of input audio signals. As shown, the audio signals are received from two or more input channels, and a set of weakly correlated components are generated. As used herein, the term "weakly correlated components" refers to a set of signal components between which the correlation is below a predefined threshold. Specifically, the components that are entirely uncorrelated may be considered as weakly correlated components. According to example embodiments disclosed herein, the components may be generated by transforming one or more combinations of the input audio signals, and therefore the number of the audio signals and the number of the components may be same or different.

Next, at block 102, the weakly correlated components are analyzed. According to example embodiments disclosed herein, a set of gains associated with the components are determined based on the analysis, wherein each gain is associated with a component. Then, at block 103, the input audio signals are decomposed into at least one of the direct and diffuse signals. As described above, each of the plurality of audio signals is associated with one of the at least two different channels. It should be appreciated that the numbers of direct and diffuse signals obtained by decomposing the plurality of audio signals depend on the characteristic of directionality and diffusion of the input audio signals.

According to example embodiments disclosed herein, the procedure 100 for decomposing the audio signals may be performed in the time domain, or in the frequency domain, including in a full band or a sub-band. A more immersive sound field may be created based on the direct and diffuse signals obtained by decomposing the audio signals with the procedure 100. Detailed procedures of blocks 101-103 will be described below with reference to FIGS. 2-6.

Figure 2:
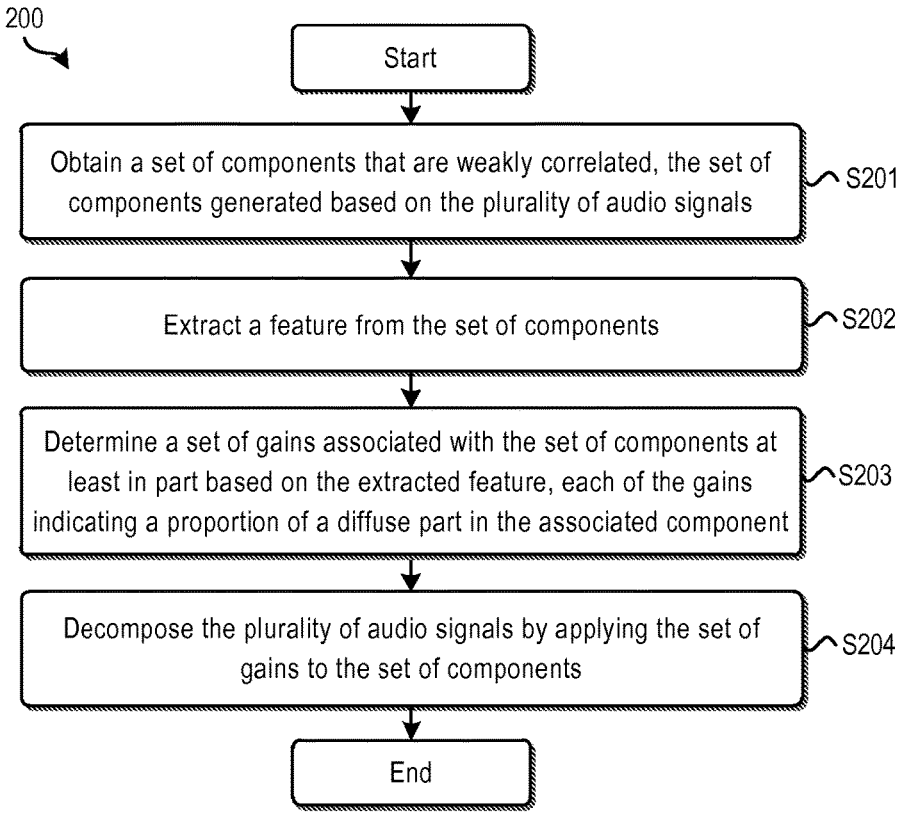
FIG. 2 illustrates a flowchart of a method for decomposing a plurality of audio signals from at least two different channels according to some example embodiments.

FIG. 2 illustrates a flowchart of a method 200 for decomposing a plurality of audio signals from at least two different channels according to some example embodiments.

As shown in FIG. 2, at step S201, a set of weakly correlated components are obtained, which are generated based on the plurality of audio signals. According to example embodiments disclosed herein, the process of obtaining the components includes generating the components and/or receiving the components from another entity. That is, the generation of the components and the subsequent process may be performed by one single entity, or by two different entities respectively.

As described above with reference to FIG. 1, the components may be generated by transforming one or more combinations of the input audio signals. According to example embodiments disclosed herein, it is possible to adopt any transformation approaches capable of generating the weakly correlated components, including, but not limited to, independent component analysis (ICA), B-format analysis, principal component analysis (PCA), and the like.

In one embodiment, an example transformation of the audio signal may be implemented using a linear equation system, such as a matrix multiplication as given in Equation (1):

$$\vec{C} = [C_1 \ \dots \ C_M] = [X_1 \ \dots \ X_M] \cdot \begin{bmatrix} \alpha_{1,1} & \dots & \alpha_{1,M} \\ \vdots & \ddots & \vdots \\ \alpha_{M,1} & \dots & \alpha_{M,M} \end{bmatrix} = \vec{X} \cdot \text{Alpha} \tag{1}$$

where $\vec{X}$ represents a row vector representing M intermediate signals obtained by combining the N input signals; Alpha represents an M·M transformation matrix, with each column vector $$\begin{bmatrix} \alpha_{1,i} \\ \vdots \\ \alpha_{M,i} \end{bmatrix},$$

(i=1, . . . , M), constrained to be a unit vector; $\vec{C}$ represents a row vector representing the M components which are weakly correlated.

According to example embodiments disclosed herein, the transformation may be performed on the audio signals in the time domain or frequency domain. With the transformation, the data vector $\vec{X}$ from an original space of M variables may be mapped to a new space of M variables which are weakly correlated. By analyzing the weakly correlated components generated from the audio signals rather than the mixed original audio signals per se, the interference due to the correlation within the audio signals may be significantly reduced. As a result, the subsequent signal decomposition may be more precise.

Next, the method 200 proceeds to step S202, where a feature is extracted from the weakly correlated components. According to example embodiments disclosed herein, the extracted feature indicates the characteristic of directionality and diffusion of the components, and may be used to facilitate the subsequent decomposition of the audio signals.

In one embodiment, the feature exacted at step S202 may include a local feature specific to one component, indicating the directionality and diffusion characteristic of the component. Alternatively or additionally, the extracted feature may include a global feature related to the whole set of components, indicating the directionality and diffusion characteristic related to the set of components.

In one embodiment, the local feature specific to one component may comprise, for example, position statistics of the component in a plurality of channels. The statistics may be performed in the time domain or frequency domain.

Generally, the positions of a direct component in a plurality of channels are more static or change more slowly over time, while the positions of a diffuse component are more random and noisy over time. As a result, the position statistics of a component in the time domain may indicate the directionality and diffusion of the component.

According to example embodiments disclosed herein, the position statistics of a component in the time domain may be represented by a change of positions of the component in the plurality of channels over time. For example, it is assumed that the unit vector $$\begin{bmatrix} \alpha_{1,i} \\ \vdots \\ \alpha_{M,i} \end{bmatrix}_t$$

indicates the positions of a component $C_{i,t}$ in M channels, where t represents the current timestamp such as the current frame. In one embodiment, a representation for the change of positions of a component is a squared Euclidean distance $D_{i,t}$ as given in Equation (2):

$$D_{i,t} = \sum_{j=1}^{M} ((\alpha_{j,i})_t - (\alpha_{j,i})_{t-1})^2 \tag{2}$$

In another embodiment, the representation for the change of positions of a component is a cosine distance $D_{i,t}$ as given in the Equation (3):

$$D_{i,t} = 1 - \sum_{j=1}^{M} (\alpha_{j,i})_t * (\alpha_{j,i})_{t-1} \tag{3}$$

In Equations (2) and (3), the position statistics in the time domain is determined by comparing the positions of a component at different times. A large value of the position statistics indicates a large part of the component is diffuse.

Alternatively, the position statistics may be determined by calculating the squared Euclidean distance or the cosine distance between the position of a component at the current time and a centroid position of the component. The centroid position may be estimated by averaging the positions of the component for a period of time. The centroid position may also be estimated such that the sum of distances between the centroid position and the positions at different times is minimized for a period of time. It should be noted that any other approaches to estimate the centroid position may be used, and the scope is not limited in this regard.

According to example embodiments disclosed herein, the accuracy of the determined centroid position may be influenced by a period of time when the statistics are performed. For example, if the period of time is too long, the statistics may be performed across different audio signal sources, and the resulted centroid position may be less accurate. In one embodiment, in order to further increase the accuracy of the determined centroid position, a transient between different audio signal sources may be detected, and the centroid position may be reset after a transient occurs.

As described above, the statistics may also be performed in the frequency domain. Generally, the positions of a direct component are more consistent in a plurality of channels across sub-bands, while the positions of a diffuse component are more diverse across sub-bands. As a result, the position statistics of a component in the frequency domain may indicate the directionality and diffusion of the component. According to example embodiments disclosed herein, the position statistics of a component in the frequency domain may be represented by a change of positions of the component in the plurality of channels across sub-bands.

In one embodiment, the position statistics in the frequency domain may be determined by comparing the positions of a component in different sub-bands. The specific approaches are similar to those for determining the position statistics in the time domain by comparing the positions of a component at different times, and therefore a detailed explanation will be omitted for the purpose of simplicity.

In another embodiment, a centroid position may be estimated across the full band, and the position statistics may be determined by calculating the distance between the position of a component in a sub-band and a centroid position of the components in the full band.

For example, it is assumed that the unit vector $$\begin{bmatrix} \alpha_{1,i} \\ \vdots \\ \alpha_{M,i} \end{bmatrix}_f$$

represents the positions of a component $C_{i,f}$ in the M channels in a sub-band f, where f=1, . . . , F represents a sub-band index, and F represents the total number of sub-bands. For the purpose of simplicity, the subscript f is omitted elsewhere unless specifically indicated. The centroid position $$\begin{bmatrix} \overline{\alpha}_{1,i} \\ \vdots \\ \overline{\alpha}_{M,i} \end{bmatrix}$$

may be estimated with the F positions as represented by the unit vector $$\begin{bmatrix} \alpha_{1,i} \\ \vdots \\ \alpha_{M,i} \end{bmatrix}_f$$

such that the sum of distances between the centroid position and the positions in all sub-bands is minimized. In one embodiment, the distance may be the squared Euclidean distance or the cosine distance.

Alternatively, the centroid position may be estimated by averaging the positions of the component $C_{i,f}$ across the full band. The diffusion of the component $C_{i,f}$ may be indicated by the distance of its positions in individual sub-bands from its centroid position, $D_{i,f}=1-\Sigma_{j=1}^{M}(\alpha_{j,i})_f*(\overline{\alpha}_{j,i})$.

For the purpose of illustration, an example of using only one centroid position has been described above. In a case where the input audio signals are complex, for example, comprising a plurality of direct signals, a plurality of centroid positions may be estimated. In this case, the distances to these centroid positions for each component may be calculated, and the minimal distance may be selected as a statistic object.

In addition to the position statistics of a component in a plurality of channels, an audio texture feature describing temporal and/or spectral characteristic of the component may also reflect the directionality and diffusion characteristic of the component. In another embodiment, the local feature specific to one component may comprise the audio texture feature of the component, such as zero-crossing rate, Mel-frequency Cesptral Coefficient (MFCC), sub-band spectral distribution such as spectral flatness, spectral crest, spectral flux, spectral peak, and the like.

As described above, after the set of weakly correlated components are obtained from the input audio signal, in addition to the local feature specific to one component, a global feature related to the whole set of components may also be extracted. Generally, the component with the largest power contains the most dominant direct signal and also parts of less dominant signals and diffuse signals which spatially coincide with the most dominant signal. When direct signals are spatially coincident with each other, the components with a smaller power may be the diffuse signals. When the direct signals are not spatially coincident, the component with a smaller power may contain another direct signal and a part of the diffuse signals which spatially coincide with the direct signal. As a result, power distributions of the components may indicate the directionality and diffusion of the audio signals.

In one embodiment, the global feature may be extracted based on the power distributions of the components. According to example embodiments disclosed herein, the power distributions may be determined in the time domain, in the full band or in a sub-band.

The global feature based on the power distributions may comprise, for example, differences between powers of the components. Generally, if a component contains a most dominant direct signal having the largest power, its power difference from another component may be larger than the power difference between two diffuse components. As a result, the larger the power difference is, the more probable the component contains the dominant direct signal.

If $[\lambda_{C_1} \ldots \lambda_{C_M}]$ $(\lambda_{C_1} > \ldots > \lambda_{C_M})$ represents the normalized power of the components, the differences of powers between each two adjacent components may be calculated, for example, as in Equation (4):

$$\Delta_i = \begin{cases} \dfrac{\lambda_{C_i} - \lambda_{C_{i+1}}}{\lambda_{C_i} + \lambda_{C_{i+1}}}, & i = 1 \\ \min\left\{\dfrac{\lambda_{C_i} - \lambda_{C_{i+1}}}{\lambda_{C_i} + \lambda_{C_{i+1}}}, \dfrac{\lambda_{C_{i-1}} - \lambda_{C_i}}{\lambda_{C_{i-1}} + \lambda_{C_i}}\right\}, & i > 1 \\ \dfrac{\lambda_{C_{i-1}} - \lambda_{C_i}}{\lambda_{C_{i-1}} + \lambda_{C_i}}, & i = M \end{cases} \tag{4}$$

Alternatively or additionally, a sum of the power differences, $\Delta=\Sigma_{i=1}^{M}\Delta_i$, may be calculated, which may indicate whether direct signals in the audio signals are more or less.

If the set of components are considered as a random variable with M outcomes, the normalized power $[\lambda_{C_1} \ldots \lambda_{C_M}]$ may be considered as the probability of each outcome. Then, the entropy of the components may be calculated as in Equation (5):

$$H = -\sum_{i=1}^{M} \lambda_{C_i} \log_{10}(\lambda_{C_i}) \tag{5}$$

The entropy calculated above may indicate how even the power distribution is across the components. If the entropy is larger, the power distribution across the components may be more even. It indicates that the directionality may be not dominant. Consequently, in addition to the differences between the powers of the components, the global feature may also comprise the entropy calculated based on normalized powers of the components.

As described above with reference to FIG. 1, the procedure for decomposing the audio signals may be performed in the time domain. Alternatively, the audio signals may be converted in to the frequency domain such that the decomposition is applied on the signals in the full band or in a sub-band. Compared with a full-band or time domain process, a sub-band process is finer and more detailed which may reveal a dominant component per sub-band. If the direct signals are sparser in sub-bands, it is more possible to detect a direct signal as a dominant direct signal in a considered sub-band by the sub-band process. As a result, the differences of the powers and positions between more dominant components in individual sub-bands obtained by the sub-band process and a more dominant component obtained by the full band process or the time domain process may indicate the number of direct signals in the input audio signals, for example, one or more direct signals.

For example, it is assumed that a unit vector $$\begin{bmatrix} \alpha_1 \\ \vdots \\ \alpha_M \end{bmatrix}_f$$

represents the position of a more dominant component $C_{1,f}$ in a sub-band f, which is the component having a larger power among the components in the sub-band f obtained by the sub-band process, and $\lambda_{C_{i,f}}$ indicates its power; a unit vector $$\begin{bmatrix} \overline{\alpha}_1 \\ \vdots \\ \overline{\alpha}_M \end{bmatrix}$$

represents the position of a more dominant component $\overline{C}_1$, which is the component having a larger power among the components obtained by the full band process or the time domain process, and $\lambda_{\overline{C}_1}$ represents its power. The global feature may comprise the features $\Delta\lambda$ and $\Delta D$ as given below:

$$\Delta\lambda=|\Sigma_{j=1}^{F}\lambda_{C_{1,j}}-\lambda_{\overline{C}_1}|, \text{ and}$$

$$\Delta D=1-\Sigma_{j=1}^{M}\alpha_j*\overline{\alpha}_j \text{ or } \Delta D=\Sigma_{j=1}^{M}(\alpha_j-\overline{\alpha}_j)^2$$

In some embodiments, the component may be the most dominant component having the largest power among the components obtained by the sub-band process or by the full band process or the time domain process.

If $\Delta\lambda$ and $\Delta D$ are small, the input audio signals may probably comprise one direct signal. If $\Delta\lambda$ and $\Delta D$ are large, the input audio may probably comprise more than one direct signal.

Alternatively or additionally, in addition to the local and global features themselves as described above, a running average and/or running variance thereof may also be used as a representative feature.

Still with reference to the method 200, at step S203, a set of gains associated with the set of weakly correlated components are determined at least in part based on the feature extracted at step S202. According to example embodiments disclosed herein, each of the gains indicates a proportion of a diffuse part of the associated component. Because a component is composed of direct and diffuse parts, the gain indicating a proportion of a diffuse part of the associated component may also indicate a proportion of a direct part of the component. In other words, a gain may indicate how much part of the associated component is direct or diffuse.

As described above, the feature extracted from the components may be more representative of the directionality and diffusion characteristic of the audio signals due to the weak correlation among the components, and therefore the gain determined based on the feature may be more precise.

According to example embodiments disclosed herein, at least one of the local features and the global features may be used as a factor for determining a gain. A gain for a component, for example, may be determined by multiplying and scaling the factors.

In order to improve the fidelity, a smoothing processing may be applied to the determined gains. For example, the gain associated with a component may be smoothed by averaging the gains determined at different time or in different sub-bands.

Alternatively or additionally, a re-initialization processing may also be applied to the determined gains. For example, when a transient between different audio signal sources is detected, the re-initialization may be performed in order to avoid the over-smoothing of the determined gains across different audio signal sources such that the accuracy of the determined gains may be further increased.

Then, the method 200 proceeds to step S204, where the plurality of audio signals from the at least two different channels are decomposed by applying the set of gains to the set of components.

According to example embodiments disclosed herein, the decomposition process of the audio signals is an inverse transformation operation on the components and the associated gains. For example, it is assumed that a row vector $\tilde{X}_{diffuse}$ represents M decomposed diffuse signals obtained by the decomposition, and $[g_1 \ldots g_M]$ represents the gains associated with the components $[C_1 \ldots C_M]$. Each gain corresponds to one component. $\tilde{X}_{diffuse}$ may be calculated as follows:

$$\tilde{X}_{diffuse}=\left([C_1 \ldots C_M]\cdot\begin{bmatrix} g_1, & \cdots & 0 \\ \vdots & \ddots & \vdots \\ 0 & \cdots & g_M \end{bmatrix}\right)\cdot\begin{bmatrix} \alpha_{1,1} & \cdots & \alpha_{1,M} \\ \vdots & \ddots & \vdots \\ \alpha_{M,1} & \cdots & \alpha_{M,M} \end{bmatrix}^T \quad (6)$$

It should be noted that the determination of diffuse signals discussed above is just for the purpose of illustration, and the decomposition method according to example embodiments disclosed herein may also be applied to determine the direct signals in the audio signals.

With the method 200, the directionality and diffusion characteristic of the input audio signals may be analyzed more precisely based on the weakly correlated signal components generated based on the input audio signals, and thereby the direct-diffuse decomposition of the audio signals may be more precise, and further a more immersive sound field may be created.

Figure 3:
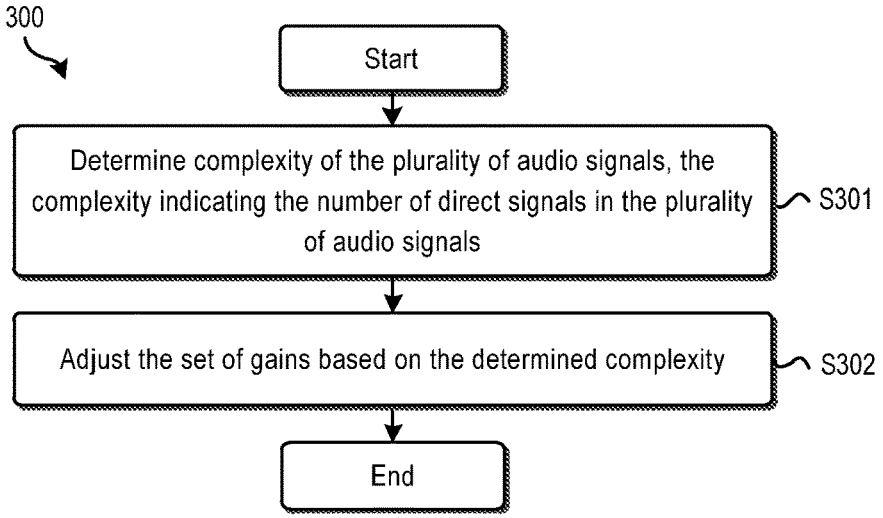
FIG. 3 illustrates a flowchart of a method for determining the gains according to one example embodiment.
Figure 4:
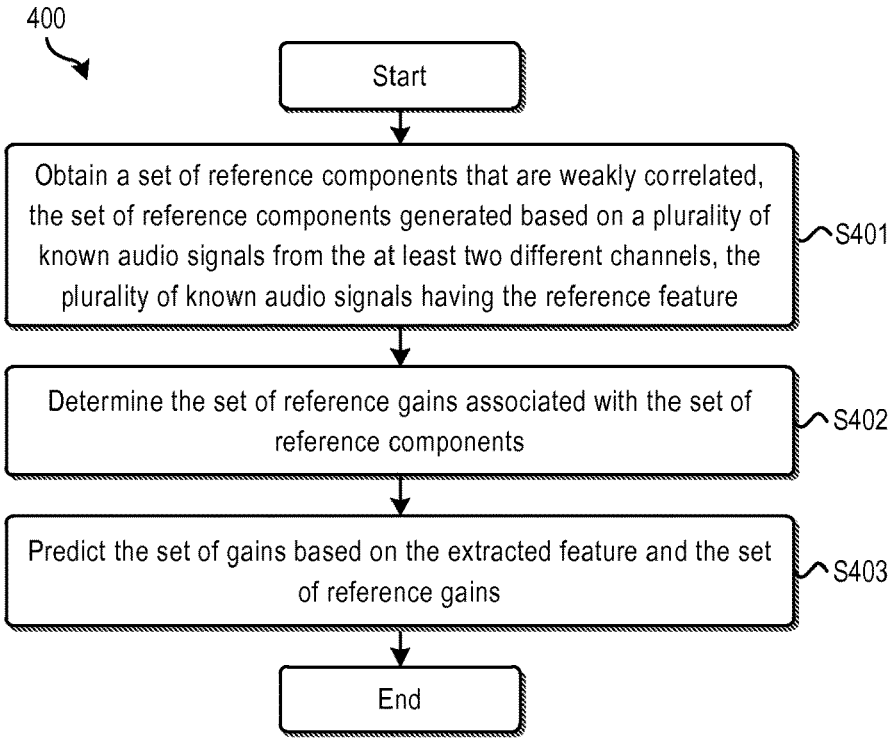
FIG. 4 illustrates a flowchart of a method for determining the gains according to another example embodiment.

FIGS. 3 and 4 show some example embodiments for determining the gains associated with the weakly correlated components, which may be implemented at block 102 in FIG. 1.

FIG. 3 illustrates a flowchart of a method 300 for determining the gains according to one example embodiment.

Generally, in audio signals input from a plurality of channels, there may be one or more direct signals from one or more direct sound source. The more the direct signals are included in the audio signals, the more complex is the direction of the audio signals.

According to example embodiments disclosed herein, the audio signals may belong to one of the following scenarios: (1) the audio signals only comprise diffuse signals; (2) the audio signals comprise a single direct signal in addition to diffuse signals; (3) the audio signals comprise multiple direct signals in addition to diffuse signals.

Accordingly, in the scenario (1), all components may mostly contribute to the diffusion of the audio signals; while in the scenarios (2) and (3), the most dominant component may contribute to the directionality of the audio signals, and the least dominant component may contribute to the diffusion of the audio signals. Due to the different number of direct signals in the scenarios (2) and (3), the moderate dominant components may contribute to either diffusion or directionality of the audio signals. Specifically, in the scenario (2), the moderate dominant components may contribute more to the diffusion, while in the scenario (3), the moderate dominant components may contribute more to the directionality. According to example embodiments disclosed herein, the gains may be adjusted based on complexity of the audio signals which, for example, indicates which scenario the audio signals belong to.

As shown in FIG. 3, at step S301, the complexity of the plurality of audio signals may be determined to indicate the number of direct signals in the plurality of audio signals.

In one embodiment, a hard decision may be used to determine the complexity of the audio signals. That is, the audio signal is determined to belong to one of the above scenarios. In another embedment, a soft decision may be used to determine a probability that the audio signals belong to one of the scenarios. For example, a score of a value 0 to 1 may be used to represent a matching degree between the audio signals and one scenario.

As described above with reference to FIG. 2, the differences of the powers and positions between the most dominant components in individual sub-bands obtained by the sub-band process and the most dominant component obtained by the full-band process or the time domain process may indicate that the number of direct signals in the input audio signals is more or less.

In one embodiment, the complexity score may be obtained based on the linear combination of the corresponding global features, for example, $\beta_1 \cdot \Delta + \beta_2 \cdot H + \beta_3 \cdot \Delta\lambda$. As described above, $\Delta$ represents the sum of the power differences of the components. If $\Delta$ is low, the input audio signals may more probably belong to the scenario (1), where the diffuse signals are included; if $\Delta$ is high, the audio signals may more probably belong to the scenarios (2) and (3), where both the direct and diffuse signals are included. H indicates how even the power distribution is across components. If H is high, the audio signals may more probably belong to the scenario (1); if H is low, the audio signals may more probably belong to the scenarios (2) and (3). $\Delta\lambda$ represents a power difference between a local dominant component in a sub-band and a global dominant component in a full band or in a time domain. If $\Delta\lambda$ is low, the audio signals may more probably belong to the scenario (2), where a single direct signal is included; if $\Delta\lambda$ is high, the audio signals may more probably belong to the scenario (3), where multiple direct signals are included.

After the complexity of the audio signals is determined, the method 300 proceeds to at step S302, where the gains are adjusted based on the determined complexity.

In one embodiment, the determined complexity score is scaled with a non-linear function $f_i(\bullet)$ for each component, and the gains are calculated as follows:

$$g_i = f(\beta_1 \cdot \Delta + \beta_2 \cdot H + \beta_3 \cdot \Delta\lambda) \cdot (A^{B \cdot \Delta_i}) \quad i=1, \ldots, M \tag{7}$$

where $\Delta_i$ represents the difference of power between a component $C_i$ and its adjacent component, A and B represent coefficients to map $\Delta_i$ to a gain $g_i \in [0, 1]$ associated with $C_i$. As a non-limited example, A=10 and B=−0.05.

It should be noted that the values of A and B may be selected according to actual requirements and/or technical person's experiences. It should also be noted that the relationship of the features and the gains as shown in Equation (7) is just for the purpose of illustration, any other combination mode of the features may be possible, and the scope is not limited in this regard.

Depending on the desired artistic effect of the input audio signals, the output signals for a plurality of channels, for example, generated by an upmixer, may provide the listener with the sensation of one or more aural components having apparent directions within an enveloping diffuse sound field having no apparent direction. As a result, there may be a need for a preference of whether to preserve directionality or diffusion of the input audio signal. According to example embodiments disclosed herein, the set of gains are further determined based on a preference of whether to preserve the directionality or diffusion of the audio signals.

FIG. 4 illustrates a flowchart of a method 400 for determining the gains according to another example embodiment.

The method 400 is entered at step S401, where a set of weakly correlated reference components are obtained. The reference components are generated based on a plurality of known audio signals from the at least two different channels, wherein the known audio signals contain known direct and diffuse signals and have a reference feature. Then, at step S402, a set of reference gains associated with the set of reference components are determined.

According to example embodiments disclosed herein, the generation of the reference components may be performed at block 101 of FIG. 1, and the determination of the gains may be performed at block 102 of FIG. 1. Then, the determined reference gains may be applied to block 103 of FIG. 1 for the decomposition of the known audio signals.

According to example embodiments disclosed herein, the reference gains may be determined such that a difference between the known directionality and diffusion characteristic of the known audio signals and the directionality and diffusion characteristic obtained by decomposing the known audio signals is minimized. For example, the reference gains may be determined such that the difference between the power of a known diffuse signal among the known audio signals and the power of a diffuse signal obtained by decomposing the known audio signals is minimized.

Alternatively or additionally, the reference gains may be determined further based on a preference of whether to preserve the directionality or diffusion of the plurality of known audio signals, as described above with reference to FIG. 3.

Specifically, in one embodiment, the known audio signals may be generated by mixing known direct and diffuse signals with the following mixing mode:

$$\overline{X} = [X_1 \ \ldots \ X_M] = [S_1 \ \ldots \ S_D] \cdot \begin{bmatrix} m_{1,1} & \cdots & m_{1,M} \\ \vdots & \ddots & \vdots \\ m_{D,1} & \cdots & m_{D,M} \end{bmatrix} + [A_1 \ \ldots \ A_M] \tag{8}$$

where $m_{i,j}$ ($i \in [1, \ldots, D]$, $j \in [1, \ldots, M]$) represents a panning function of a direct signal $S_i$ to the jth channel, and $A_i$ represents a diffuse signal.

Based on the mixing mode as given in Equation (8), the reference gains $[g_1 \ldots g_M]$ may then be determined with the following optimization criterion:

$$\min_{0 \le [g_1 \ \ldots \ g_M] \le 1} \left\{ \sum_{f=1}^{F} \left| W_1 \cdot E\left(\overline{X} - \tilde{X}_{diffuse}\right) - W_2 \cdot \sum_{i=1}^{D} E(S_i) \right|_f \right\} \tag{9}$$

where $E(\bullet)$ represents the power of the signal, $W_1$ represents a penalty factor for diffusion-to-directionality leakage, $W_2$ represents a penalty factor for direction-to-diffusion leakage, $f=1, \ldots, F$ represents a sub-band index, and F represents the total number of sub-bands. According to example embodiments disclosed herein, $W_1$ and $W_2$ may be either frequency-dependent or frequency-independent.

In one embodiment, a regression technique may be applied to the determination of the reference gains. For example, the determination of the reference gains may be performed regressively until the optimization criterion is met. Regression methods may include the least squares regression analysis and inference, Bayesian linear regression, distance metric learning, and the like.

Alternatively or additionally, a classification technique may be also applied to the determination of the reference gains. For example, the reference gains may be determined for the reference feature of the known audio signals based on a classification method. The Classification methods may include probabilistic classification modeling techniques like Gaussian Mixture Models (GMM), or discriminative methods like Support Vector Machine (SVM) or AdaBoost. In one embodiment, Least Squares Support Vector Machines (LS-SVM) may be adopted.

According to example embodiments disclosed herein, the reference feature of the known audio signals may include at least one of the local and global features as described above. For the purpose of simplicity, the detailed description related to the features will not be repeated.

Still with reference to the method 400, the gains for decomposing the input audio signals are determined based on the feature extracted for the input audio signals and the reference gains determined for the reference feature of the known audio signals at step S403. For example, the final gains may be predicted using the learned LS-SVM models based on the extracted feature, the reference feature, and the reference gains.

Figure 5:
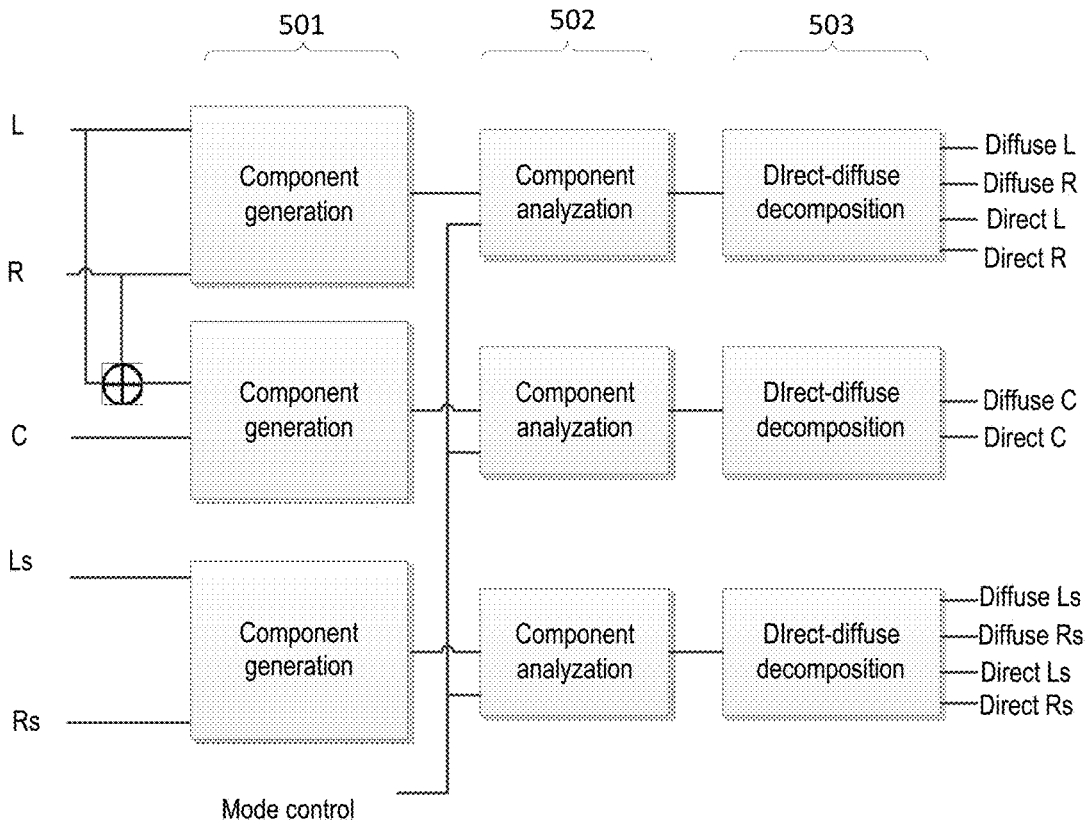
FIG. 5 illustrates a block diagram of a procedure for decomposing the plurality of audio signals according to some example embodiments.

FIG. 5 illustrates a block diagram of a procedure 500 for decomposing the plurality of audio signals according to some example embodiments disclosed herein.

As shown in FIG. 5, audio signals are input from five channels (L, R, C, Ls, Rs), which are grouped into channel pairs, for example, [L, R], [Ls, Rs], [C, F], where F represents a channel mixed with L and R.

In one embodiment, in block 501 of component generation as shown in FIG. 5, the covariance of the signals from a pair of channels is calculated, and the covariance may be smoothed by averaging over time. Then, the covariance may be normalized to obtain a correlation coefficient. The covariance and correlation coefficient may be used to calculate the transformation matrix for determining two components per sub-band.

Next, in block 502 of component analysis, the gain for each component may be determined.

Then, in block 503 of direct-diffuse decomposition, the audio signals input from each pair of channels may be decomposed by applying the inverse transformation matrix, and accordingly two sets of audio signals are generated, wherein one is direct and the other is diffuse.

Specifically, in one embodiment, the input audio signals are represented as a row vector containing the left and right coefficients, X=[L,R]. Power Sum $S_f$, Power Difference $D_f$ and Real part of Cross-Correlation $R_f$ are calculated. Each statistical estimate of the Power Sum $S_f$, Power Difference $D_f$ and Real part of Cross-Correlation $R_f$ is accumulated over a time block (index b) and over a sub-band (index f) and smoothed over time using a frequency dependent leaky integrator:

$$S_f(b) = (1 - a_f)S_f(b-1) + a_f \sum_{i \in f} \sum_{j \in b} (L_{i,j}^2 + R_{i,j}^2) \tag{10}$$

$$D_f(b) = (1 - a_f)D_f(b-1) + a_f \sum_{i \in f} \sum_{j \in b} (L_{i,j}^2 - R_{i,j}^2) \tag{11}$$

$$R_f(b) = (1 - a_f)R_f(b-1) + 2a_f \sum_{i \in f} \sum_{j \in b} \mathcal{R}(L_{i,j}R_{i,j}) \tag{12}$$

The signal decomposition is performed using the transformation matrix as given in Equation (13):

$$\tilde{X}_{diffuse} == \left( [X_L, X_R] \cdot \begin{bmatrix} \alpha_{1,1} & \alpha_{1,2} \\ \alpha_{2,1} & \alpha_{2,2} \end{bmatrix} \cdot \begin{bmatrix} g_1 & 0 \\ 0 & g_2 \end{bmatrix} \right) \cdot \begin{bmatrix} \alpha_{1,1} & \alpha_{1,2} \\ \alpha_{2,1} & \alpha_{2,2} \end{bmatrix}^T \tag{13}$$

Where:

$$\alpha_{1,2}^2 = \frac{\sqrt{|R_f(b)|^2 + |D_f(b)|^2} + D_f(b)}{2S_f(b)},$$

$$\alpha_{2,2}^2 = \frac{\sqrt{|R_f(b)|^2 + |D_f(b)|^2} - D_f(b)}{2S_f(b)},$$

$\alpha_{1,1}^2 = 1 - \alpha_{1,2}^2$, $\alpha_{2,1}^2 = 1 - \alpha_{2,2}^2$, and $a_f (0 < a_f < 1)$ represents a smoothing factor.

The procedure for performing the decomposition based on each channel pairs has been described above with reference to FIG. 5. In some other embodiments, the decomposition may be performed based on PCA, wherein any number of channels may be used to perform the decomposition.

For example, for 5-channel signals (L, R, C, Ls, Rs) as shown in FIG. 5, in the procedure 500 of using channel pairs, the decomposition may be performed based on each pair of channels separately (L-R, L-C, L-Ls, L-Rs, R-C, R-Ls, R-Rs, C-Ls, C-Rs, Ls-Rs) and 10 stereo direct signals and 10 diffuse signals are output respectively. Instead, in the procedure based on PCA, eigen decomposition may be performed on a 5×5 covariance matrix of the 5-channel signals and five components may be output.

An example procedure based on PCA is as follows:

1. Audio signals may be input from N channels, and Short Time Fourier transform (STFT) may be performed on the audio signals.

2. A covariance matrix may be calculated for each frequency band f∈[1, . . . , F], and the covariance may be smoothed by averaging over time.

3. The eigen decomposition may be performed on the obtained covariance matrix, and M components with eigenvectors $v_m$ and eigenvalues $\lambda_1, \ldots, \lambda_m$, e.g., $\lambda_1 > \lambda_2 > \lambda_3 > \ldots > \lambda_m$ (assuming M=N), may be obtained, wherein each eigenvalue indicates the power of a respective individual component, and the eigenvector indicates the positions of each component in the N channels.

4. The analysis may be performed on the M components, the local and global features may be extracted from the M components, and then the gains for each component may be determined based on the features.

5. The gains may be multiplied on corresponding components, and the final diffuse and direct signals may be obtained by multiplying inversion of the eigenvectors.

Figure 6:
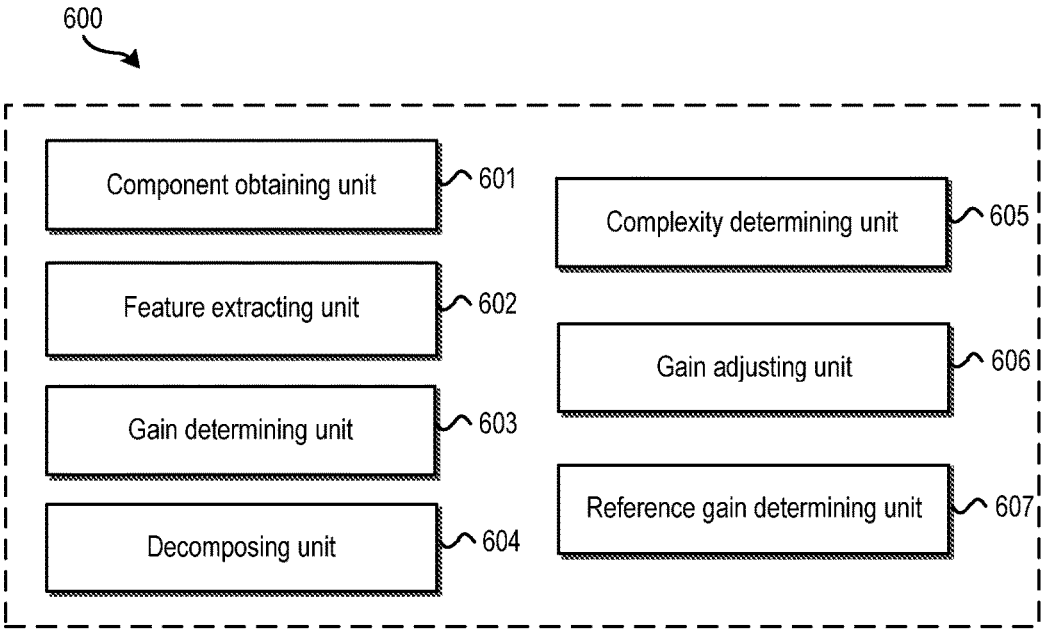
FIG. 6 illustrates a block diagram of a system for decomposing a plurality of audio signals from at least two different channels according to some example embodiments.

FIG. 6 illustrates a block diagram of a system 600 for decomposing a plurality of audio signals from at least two different channels according to some example embodiments disclosed herein.

As illustrated in FIG. 6, the system 600 comprises a component obtaining unit 601, a feature extracting unit 602, a gain determining unit 603 and a decomposing unit 604. The component obtaining unit 601 may be configured to obtain a set of components that are weakly correlated, wherein the set of components are generated based on the plurality of audio signals. The feature extracting unit 602 may be configured to extract a feature from the set of components. The gain determining unit 603 may be configured to determine a set of gains associated with the set of components at least in part based on the extracted feature, wherein each of the gains indicates a proportion of a diffuse part in the associated component. The decomposing unit 604 may be configured to decompose the plurality of audio signals by applying the set of gains to the set of components.

In some embodiments, the feature extracting unit 602 may be further configured to extract a local feature specific to one of the components. In some embodiments, the feature extracting unit 602 may be further configured to extract a global feature related to the set of components.

In some embodiments, for the local feature specific to one of the components, the feature extracting unit 602 may be further configured to determine position statistics of the component in the at least two different channels. In some embodiments, the feature extracting unit 602 may be further configured to extract, for the local feature specific to one of the components, an audio texture feature of the component.

In some embodiments, the feature extracting unit 602 may be further configured to extract the global feature based on power distributions of the components. For example, the feature extracting unit 602 may be further configured to determine differences between powers of the components. Alternatively or additionally, the feature extracting unit 602 may be further configured to calculate entropy based on normalized powers of the components.

In some embodiments, the component obtaining unit 601 may be further configured to obtain a first set of components that are weakly correlated and a second set of components that are weakly correlated, wherein the first set of components generated in a sub-band and the second set of components generated in a full band or in a time domain. The feature extracting unit 602 may be further configured to determine a difference between a first power and a second power, the first power being a larger power of the first set of components and a second power being a larger power of the second set of components. Alternatively or additionally, the feature extracting unit 602 may be further configured to determine a difference between a first position of a first component having the first power in the at least two different channels and a second position of a second component having the second power in the at least two different channels.

In some embodiments, the system 600 may further comprise a complexity determining unit 605 and a gain adjusting unit 606. The complexity determining unit 605 may be configured to determine complexity of the plurality of audio signals, wherein the complexity indicates the number of direct signals in the plurality of audio signals. The gain adjusting unit 606 may be configured to adjust the set of gains based on the determined complexity.

In some embodiments, the gain determining unit 603 may be further configured to determine the set of gains based on the extracted feature and a preference of whether to preserve directionality or diffusion of the plurality of audio signals.

In some embodiments, the gain determining unit 603 may be further configured to predict the set of gains based on the extracted feature and a set of reference gains determined for a reference feature.

In some embodiments, the component obtaining unit 601 may be further configured to obtain a set of reference components that are weakly correlated, the set of reference components generated based on a plurality of known audio signals from the at least two different channels, the plurality of known audio signals having the reference feature. The system 600 may further comprise a reference gain determining unit 607. The reference gain determining unit 607 may be configured to determine the set of reference gains associated with the set of reference components such that a difference between first characteristic of directionality and diffusion of the plurality of the known audio signals and second characteristic of directionality and diffusion is minimized, the second characteristic obtained by decomposing the plurality of the known audio signals by applying the set of reference gains to the set of reference components.

In some embodiments, the reference gain determining unit 607 may be further configured to determine the set of reference gains based on a determination of whether to preserve directionality or diffusion of the plurality of known audio signals.

For the sake of clarity, some optional components of the system 600 are not illustrated in FIG. 6. However, it should be appreciated that the features as described above with reference to FIGS. 1-5 are all applicable to the system 600. Moreover, the components of the system 600 may be a hardware module or a software unit module. For example, in some example embodiments disclosed herein, the system 600 may be implemented partially or completely with software and/or firmware, for example, implemented as a computer program product embodied in a computer readable medium. Alternatively or additionally, the system 600 may be implemented partially or completely based on hardware, for example, as an integrated circuit (IC), an application-specific integrated circuit (ASIC), a system on chip (SOC), a field programmable gate array (FPGA), and so forth. The scope of the example embodiments are not limited in this regard.

Figure 7:
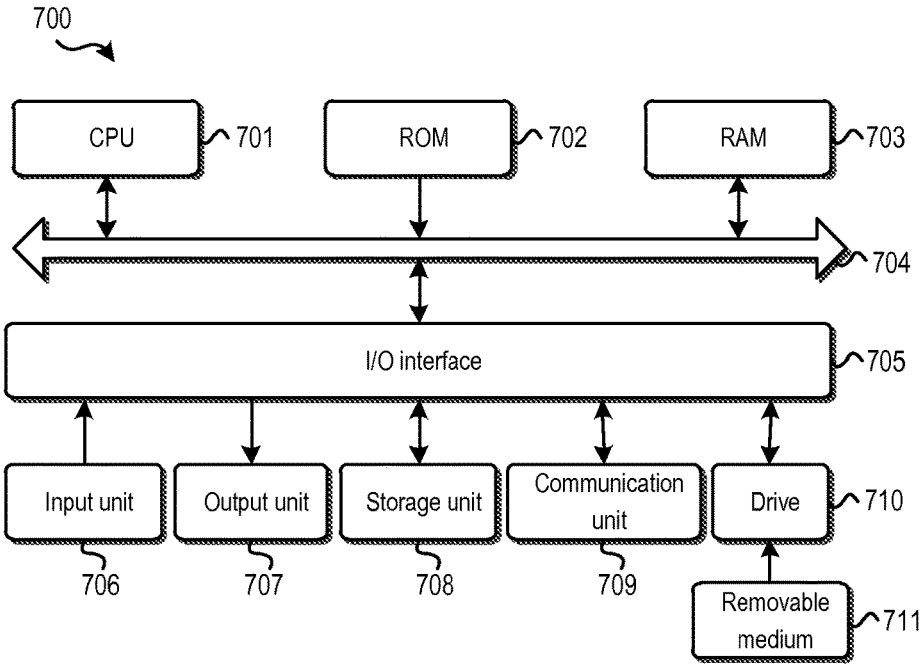
FIG. 7 illustrates a block diagram of an example computer system suitable for implementing embodiments.

FIG. 7 illustrates a block diagram of an example computer system 700 suitable for implementing example embodiments disclosed herein. As illustrated, the computer system 700 comprises a central processing unit (CPU) 701 which is capable of performing various processes according to a program stored in a read only memory (ROM) 702 or a program loaded from a storage section 708 to a random access memory (RAM) 703. In the RAM 703, data required when the CPU 701 performs the various processes or the like is also stored as required. The CPU 701, the ROM 702 and the RAM 703 are connected to one another via a bus 704. An input/output (I/O) interface 705 is also connected to the bus 704.

The following components are connected to the I/O interface 705: an input section 706 including a keyboard, a mouse, or the like; an output section 707 including a display such as a cathode ray tube (CRT), a liquid crystal display (LCD), or the like, and a loudspeaker or the like; the storage section 708 including a hard disk or the like; and a communication section 705 including a network interface card such as a LAN card, a modem, or the like. The communication section 705 performs a communication process via the network such as the internet. A drive 710 is also connected to the I/O interface 705 as required. A removable medium 711, such as a magnetic disk, an optical disk, a magneto-optical disk, a semiconductor memory, or the like, is mounted on the drive 710 as required, such that a computer program read therefrom is installed into the storage section 708 as required.

Specifically, according to example embodiments disclosed herein, the processes described above with reference to FIGS. 1-5 may be implemented as computer software programs. For example, example embodiments disclosed herein comprise a computer program product including a computer program tangibly embodied on a machine readable medium, the computer program including program code for performing methods 200, 300 and/or 400. In such embodiments, the computer program may be downloaded and mounted from the network via the communication section 705, and/or installed from the removable medium 711.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks illustrated in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the example embodiments disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order illustrated or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any embodiment or of what may be claimed, but rather as descriptions of features that may be specific to particular embodiments of particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications, adaptations to the foregoing example embodiments of this embodiment may become apparent to those skilled in the relevant arts in view of the foregoing description, when read in conjunction with the accompanying drawings. Any and all modifications will still fall within the scope of the non-limiting and example embodiments of this embodiment. Furthermore, other embodiments set forth herein will come to mind to one skilled in the art to which these embodiments pertain having the benefit of the teachings presented in the foregoing descriptions and the drawings.

Accordingly, the example embodiments disclosed herein may be embodied in any of the forms described herein. For example, the following enumerated example embodiments (EEEs) describe some structures, features, and functionalities of some aspects of the example embodiments disclosed herein.

EEE 1. A method or apparatus for decomposing input multi-channel (two or more channels) audio signals into diffuse audio signals and direct audio signals, the apparatus comprising: a. a signal decomposer configured to derive multiple (two or more) intermediate components from the multi-channel input audio signals; b. a component analyzer configured to derive features on the basis of the components, and predict diffusion gains for each component based on these derived features, which can optionally be adjusted by a preference of whether to preserve directionality or diffusion of the audio signals; c. a diffuse and direct decomposer configured to derive diffuse signals and direct signals.

EEE 2. The apparatus according to EEE 1, wherein the signal decomposer is configured to map the input audio signals into multiple components which are uncorrelated (or weakly correlated) over the dataset through a transformation operation.

EEE 3. The apparatus according to EEE 2, wherein the transformation operation is configured to derive the multiple uncorrelated (or weakly correlated) components on the basis of time domain, full-band frequency domain and/or sub-band frequency domain representation of the input audio signals.

EEE 4. The apparatus according to EEE 1, wherein the component analyzer is configured to derive intra-component features on the basis of one component and/or inter-component features on the basis of a group of components.

EEE 5. The apparatus according to EEE 4, wherein the intra-component features comprises at least one of the follows: a. component's spatial statistics over time, which are configured to calculate the spatial change of each component along time; b. component's spatial statistics across sub-bands, which are configured to calculate the spatial change of each component across sub-bands; c. audio texture features describing temporal and/or spectral properties of a component; d. running average and/or running variances of the above features.

EEE 6. The apparatus according to EEE 4, wherein intra-component feature extraction is configured to calculate spatial changes between positions in adjacent frames, and/or between the position at the current time and a running average of the positions or a centroid position over a period of time.

EEE 7. The apparatus according to EEE 4, wherein intra-component feature extraction is configured to calculate spatial distance between the position of each sub-band and the centroid positions across all sub-bands.

EEE 8. The apparatus according to EEE 4, wherein intra-component feature extraction is configured to calculate the minimal spatial distance between the position of each sub-band and a plurality of centroid spatial positions.

EEE 9. The apparatus according to EEE 4 and 5, wherein the spatial change is calculated as at least one of the following: a. Cosine distance; b. Euclidean distance; c. running average and/or running variances of the above distances.

EEE 10. The apparatus according to EEE 4, wherein the component analyzer re-initiates the feature calculation process when a transient is detected.

EEE 11. The apparatus according to EEE 4, wherein the inter-component feature extraction is configured to calculate power distributions among components.

EEE 12. The apparatus according to EEE 4, wherein the inter-component feature extraction calculates at least one of the following: a. power differences between each two adjacent components ranked based on power; b. a global feature indicating the sum of the power differences between each two adjacent components ranked based on power; c. a global feature indicating entropy based on normalized powers of all components; d. global features indicating power and spatial differences between the most dominant components obtained in sub-band frequency analysis and obtained in full-band frequency (or time domain) analysis; e. running average and/or running variances of the above features.

EEE 13. The apparatus according to EEE 12, wherein the feature of power differences is calculated on the basis of the normalized power of each component:

$$\Delta_i = \begin{cases} \dfrac{\lambda_{C_i} - \lambda_{C_{i+1}}}{\lambda_{C_i} + \lambda_{C_{i+1}}}, & i = 1 \\ \min\left\{\dfrac{\lambda_{C_i} - \lambda_{C_{i+1}}}{\lambda_{C_i} + \lambda_{C_{i+1}}}, \dfrac{\lambda_{C_{i-1}} - \lambda_{C_i}}{\lambda_{C_{i-1}} + \lambda_{C_i}}\right\}, & i > 1 \\ \dfrac{\lambda_{C_{i-1}} - \lambda_{C_i}}{\lambda_{C_{i-1}} + \lambda_{C_i}}, & i = M \end{cases}$$

wherein the normalized powers are ranked in a descending order: $\lambda_{C_1} > \ldots > \lambda_{C_M}$.

EEE 14. The apparatus according to EEE 12, wherein the feature of entropy is calculated on the basis of the normalized power of each component: $H = -\Sigma_{i=1}^{M} \lambda_{C_i} \log_{10}(\lambda_{C_i})$.

EEE 15. The apparatus according to EEE 12, wherein the feature of power difference is calculated based on the power obtained in sub-band analysis and that obtained in full-band (or time domain) analysis: $\Delta\lambda = |\Sigma_{f=1}^{F} \lambda_{C_{i,f}} - \lambda_{\overline{C}_1}|$.

EEE 16. The apparatus according to EEE 12, wherein the feature of spatial difference is calculated based on the spatial information obtained in sub-band analysis and that obtained in full-band (or time domain) analysis: $\Delta D = 1 - \Sigma_{j=1}^{M} \alpha_j * \overline{\alpha}_j$ (in the case of cosine distance) or $\Delta D = \Sigma_{j=1}^{M} (\alpha_j - \overline{\alpha}_j)^2$ (in the case of Euclidean distance).

EEE 17. The component analyzer is configured to: a. map the global inter-component features to a multiplier with a non-linear component-dependent mapping function; b. map the local features to another multiplier for each component with a mapping function; c. estimate diffusion gain factors for each component by multiplying and scaling the above multipliers.

EEE 18. The apparatus according to EEE 17, wherein the estimated diffusion gain factors are applied with a smoothing mechanism in time dimension and/or spectral dimension, together with a re-initialization mechanism through transient detection.

EEE 19. The apparatus according to EEE 17, wherein the component analyzer maps the global inter-component features to a factor for each component through auditory complexity analysis.

EEE 20. The apparatus according to EEE 17, wherein the component analyzer is configured to predict different auditory complexities belonging to different classes including at least one of the below: 1) a class comprising ambiances, and 2) a class comprising both dominant sources and ambiances, and further belonging to sub-classes including at least one of the below: 3) a class comprising a single dominant source and ambiances, and 4) a class comprising multiple dominant sources and ambiances.

EEE 21. The apparatus according to EEE 17, wherein an auditory complexity analyzer is configured to combine the global inter-component features with a linear or non-linear function to get an audio complexity score.

EEE 22. The apparatus according to EEE 17, wherein the component analyzer is configured to: a. scale audio complexity scores with a non-linear function, which is component-dependent and configurable according to a preference of whether to preserve directionality or diffusion of the audio signals; b. scale one or more local features with another non-linear function; c. calculate the gain factors for each component by multiplying the above two scaled values.

EEE 23. The component analyzer is configured with pre-learned models for predicting an outcome of diffuse gain factors based on one or more audio component features.

EEE 24. The apparatus according to EEE 23, wherein the model learner is configured to: a. mix dominant sources and ambiances; b. decompose the mixed audio signal into audio components; c. calculate audio component features including at least one of inter-component features and/or intra-component features; d. determinate gain factors for each component based on the above mixing model; e. apply regression and/or classification techniques to train the model to predict the gain factors based on the audio component features.

EEE 25. The apparatus according to EEE 24, wherein a gain determinator is configured to estimate the gain factors by minimizing a weighted value related to a diffuse-to-direct leakage plus a weighted value related to a direct-to-diffuse leakage.

It will be appreciated that the embodiments are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for providing a sound field comprising:

obtaining a set of components that are weakly correlated, the set of components generated based on applying a transformation, to a received plurality of audio signals from at least two different channels, that causes the set of components to have correlations below a predefined threshold;

extracting a feature from the set of components;

determining a set of gains associated with the set of components at least in part based on the extracted feature, each of the set of gains indicating a proportion of a diffuse part in the associated set of components;

decomposing the plurality of audio signals by applying the set of gains to the set of components; and providing the decomposed plurality of audio signals to an upmixer for subsequent output as the sound field.

2. The method according to claim 1, wherein extracting the feature comprises at least one of the following:

extracting a local feature specific to one of the set of components; and extracting a global feature related to the set of components, wherein extracting the global feature comprises:

extracting the global feature based on power distributions of the set of components.

3. The method according to claim 2, wherein extracting the local feature comprises at least one of the following:

determining position statistics of the one of the set of components in the at least two different channels; and extracting an audio texture feature of the one of the set of components.

4. The method according to claim 2, wherein extracting the global feature based on power distributions of the set of components comprises at least one of the following:

determining differences between powers of the set of components; and calculating entropy based on normalized powers of the set of components.

5. The method according to claim 2, wherein obtaining the set of components further comprises:

obtaining a first set of components that are weakly correlated and a second set of components that are weakly correlated, the first set of components generated in a sub-band and the second set of components generated in a full band or in a time domain, and wherein extracting the global feature based on power distributions of the set of components comprises at least one of the following:

determining a difference between a first power and a second power, the first power being a larger power of the first set of components and the second power being a larger power of the second set of components; and determining a difference between a first position of a first component having the first power in the at least two different channels and a second position of a second component having the second power in the at least two different channels.

6. The method according to claim 1, further comprising:

determining complexity of the plurality of audio signals, the complexity indicating a number of direct signals in the plurality of audio signals; and adjusting the set of gains based on the determined complexity, wherein determining the set of gains comprises:

determining the set of gains based on the extracted feature and a preference of whether to preserve directionality or diffusion of the plurality of audio signals.

7. The method according to claim 1, wherein determining the set of gains comprises:

predicting the set of gains based on the extracted feature and a set of reference gains determined for a reference feature.

8. The method according to claim 7, further comprising:

obtaining a set of reference components that are weakly correlated, the set of reference components generated based on a plurality of known audio signals from the at least two different channels, the plurality of known audio signals having the reference feature; and determining the set of reference gains associated with the set of reference components such that a difference between first characteristic of directionality and diffusion of the plurality of the known audio signals and second characteristic of directionality and diffusion is minimized, the second characteristic obtained by decomposing the plurality of the known audio signals by applying the set of reference gains to the set of reference components.

9. The method according to claim 8, wherein determining the set of reference gains further comprises:

determining the set of reference gains based on a preference of whether to preserve directionality or diffusion of the plurality of known audio signals.

10. A system for providing a sound field, the system comprising:

a component obtaining unit configured to obtain a set of components that are weakly correlated, the set of components generated based on applying a transformation, to a received plurality of audio signals from at least two different channels, that causes the set of components to have correlations below a predefined threshold;

a feature extracting unit configured to extract a feature from the set of components;

a gain determining unit configured to determine a set of gains associated with the set of components at least in part based on the extracted feature, each of the gains indicating a proportion of a diffuse part in the associated set of components;

a decomposing unit configured to decompose the plurality of audio signals by applying the set of gains to the set of components, the decomposing unit providing the decomposed plurality of audio signals to an upmixer for subsequent output as the sound field.

11. The system according to claim 10, wherein the feature extracting unit is further configured to do at least one of the following:

extract a local feature specific to one of the set of components; and extract a global feature related to the set of components, wherein the feature extracting unit is further configured to extract the global feature based on power distributions of the set of components.

12. The system according to claim 11, wherein the feature extracting unit is further configured to do at least one of the following:

determine position statistics of the one of the set of components in the at least two different channels; and extract an audio texture feature of the one of the set of components.

13. The system according to claim 11, wherein the feature extracting unit is further configured to do at least one of the following:

determine differences between powers of the set of components; and calculate entropy based on normalized powers of the set of components.

14. The system according to claim 11, wherein the component obtaining unit is further configured to:

obtain a first set of components that are weakly correlated and a second set of components that are weakly correlated, the first set of components generated in a sub-band and the second set of components generated in a full band or in a time domain, and wherein the feature extracting unit is further configured to do at least one of the following:

determine a difference between a first power and a second power, the first power being a larger power of the first set of components and the second power being a larger power of the second set of components; and determine a difference between a first position of a first component having the first power in the at least two different channels and a second position of a second component having the second power in the at least two different channels.

15. The system according to claim 10, further comprising:

a complexity determining unit configured to determine complexity of the plurality of audio signals, the complexity indicating a number of direct signals in the plurality of audio signals; and a gain adjusting unit configured to adjust the set of gains based on the determined complexity.

16. The system according to claim 15, wherein the gain determining unit is further configured to:

determine the set of gains based on the extracted feature and a preference of whether to preserve directionality or diffusion of the plurality of audio signals.

17. The system according to claim 10, wherein the gain determining unit is further configured to:

predict the set of gains based on the extracted feature and a set of reference gains determined for a reference feature.

18. The system according to claim 17, wherein the component obtaining unit is further configured to:

obtain a set of reference components that are weakly correlated, the set of reference components generated based on a plurality of known audio signals from the at least two different channels, the plurality of known audio signals having the reference feature; and the system further comprises:

a reference gain determining unit configured to determine the set of reference gains associated with the set of reference components such that a difference between first characteristic of directionality and diffusion of the plurality of the known audio signals and second characteristic of directionality and diffusion is minimized, the second characteristic obtained by decomposing the plurality of the known audio signals by applying the set of reference gains to the set of reference components.

19. The system according to claim 18, wherein the reference gain determining unit is further configured to:

determine the set of reference gains based on a preference of whether to preserve directionality or diffusion of the plurality of known audio signals.

20. A computer program product for providing a sound field, the computer program product being tangibly stored on a non-transient computer-readable medium and comprising machine executable instructions which, when executed, cause a machine to perform steps of the method according to claim 1.

* * * * *